US012252304B2

(12) United States Patent
Lohrman

(10) Patent No.: US 12,252,304 B2
(45) Date of Patent: Mar. 18, 2025

(54) TETHERED, HINGED CLOSURE WITH MODIFIED PRIMARY SLIT

(71) Applicant: Silgan White Cap LLC, Downers Grove, IL (US)

(72) Inventor: Richard D. Lohrman, Montgomery, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 0 days.

(21) Appl. No.: 18/173,544

(22) Filed: Feb. 23, 2023

(65) Prior Publication Data

US 2023/0257169 A1 Aug. 17, 2023

Related U.S. Application Data

(63) Continuation of application No. PCT/US2023/062209, filed on Feb. 8, 2023.

(60) Provisional application No. 63/309,126, filed on Feb. 11, 2022.

(51) Int. Cl.
*B65D 41/34* (2006.01)
*B65D 55/16* (2006.01)

(52) U.S. Cl.
CPC ..... *B65D 41/3428* (2013.01); *B65D 55/16* (2013.01); *B65D 2401/30* (2020.05)

(58) Field of Classification Search
CPC B65D 41/34; B65D 41/3428; B65D 41/3447; B65D 41/02; B65D 55/16; B65D 2401/20; B65D 2401/30; B65D 2251/023; B65D 2251/1008; B65D 1/0246; B65D 53/00
USPC ..... 215/235, 252–254, 243, 272; 220/263, 220/268, 288, 832, 847
See application file for complete search history.

(56) References Cited

U.S. PATENT DOCUMENTS 2,990,077 A 6/1961 Baarn
3,441,161 A 4/1969 Baarn
3,957,169 A * 5/1976 Coursaut ..... B65D 41/348 215/253
4,394,918 A 7/1983 Grussen
(Continued)

FOREIGN PATENT DOCUMENTS

CN 1631740 6/2005
CN 1631741 6/2005
(Continued)

OTHER PUBLICATIONS

International Search Report and Written Opinion for International Application No. PCT/US2020/049493, dated Dec. 17, 2020, 13 pages.

(Continued)

*Primary Examiner* — Chun Hoi Cheung
*Assistant Examiner* — Brijesh V. Patel
(74) *Attorney, Agent, or Firm* — Reinhart Boerner Van Deuren s.c.

(57) ABSTRACT

A closure includes a cap having a top wall and a skirt perpendicular to the top wall and extending downwardly from the top wall to a lower edge. The skirt includes an inner surface having a sealing formation. A band is concentric with and attached to the lower edge of the skirt by a plurality of frangible members. A tab is formed at a hinge location from the band and extending from the lower edge of the skirt to one or more lines of weakness.

20 Claims, 7 Drawing Sheets

(56) References Cited

U.S. PATENT DOCUMENTS

| | | | | |
|---|---|---|---|---|
| 4,494,664 | A * | 1/1985 | Guala | B65D 41/0414 215/258 |
| 4,557,393 | A | 12/1985 | Boik | |
| 4,565,295 | A | 1/1986 | Mori et al. | |
| 4,666,053 | A | 5/1987 | Corcoran et al. | |
| 4,784,281 | A * | 11/1988 | Rozenberg | B65D 41/3409 215/252 |
| 4,805,792 | A | 2/1989 | Lecinski, Jr. | |
| 5,215,204 | A | 6/1993 | Beck et al. | |
| 5,295,600 | A | 3/1994 | Kowal | |
| 5,360,126 | A | 11/1994 | Snyder et al. | |
| 5,398,837 | A | 3/1995 | Degrassi | |
| 5,676,269 | A | 10/1997 | Blake et al. | |
| 5,725,115 | A | 3/1998 | Bosl et al. | |
| 5,735,418 | A | 4/1998 | Erb et al. | |
| 5,779,075 | A | 7/1998 | Salmon et al. | |
| 5,853,095 | A | 12/1998 | Marshall et al. | |
| 6,102,257 | A | 8/2000 | Goyet | |
| 6,116,443 | A | 9/2000 | Parrinello | |
| 6,372,167 | B1 | 4/2002 | Morini | |
| 6,474,491 | B1 | 11/2002 | Benoit-Gonin et al. | |
| 6,478,184 | B2 | 11/2002 | Berge et al. | |
| 6,986,434 | B1 | 1/2006 | Getsy et al. | |
| 7,314,150 | B2 | 1/2008 | Skillen | |
| D593,856 | S | 6/2009 | Kubler | |
| 7,712,618 | B2 | 5/2010 | Barre et al. | |
| D648,215 | S | 11/2011 | Rigling et al. | |
| 8,469,213 | B2 | 6/2013 | Ishii et al. | |
| 8,490,805 | B2 | 7/2013 | Giraud et al. | |
| 8,602,234 | B2 | 12/2013 | Hayashi | |
| 8,695,822 | B2 | 4/2014 | Kwon | |
| 8,720,716 | B2 | 5/2014 | Campbell | |
| 9,010,555 | B2 | 4/2015 | Luzzato et al. | |
| 9,108,774 | B2 | 8/2015 | Kwon | |
| 9,376,243 | B2 | 6/2016 | Cerveny | |
| 9,643,762 | B2 | 5/2017 | Maguire | |
| 9,776,779 | B2 | 10/2017 | Campbell | |
| 9,828,146 | B2 | 11/2017 | Maguire | |
| 9,932,159 | B2 | 4/2018 | Maguire | |
| 9,975,677 | B2 | 5/2018 | Maguire | |
| 10,138,035 | B2 | 11/2018 | Loukov | |
| 10,272,599 | B2 | 4/2019 | Cerveny | |
| 10,518,942 | B2 | 12/2019 | Seibert et al. | |
| 10,647,486 | B2 | 5/2020 | Maguire | |
| 10,654,624 | B2 | 5/2020 | Sung | |
| 10,654,625 | B2 | 5/2020 | Migas et al. | |
| 10,836,549 | B2 | 11/2020 | Maguire | |
| 10,981,700 | B2 | 4/2021 | Migas et al. | |
| 11,040,806 | B2 | 6/2021 | Naumann et al. | |
| 2003/0136783 | A1 | 7/2003 | Hatsumoto et al. | |
| 2006/0049204 | A1 | 3/2006 | Seelhofer | |
| 2006/0071000 | A1 | 4/2006 | Weist et al. | |
| 2006/0163281 | A1 | 7/2006 | Weist | |
| 2007/0151993 | A1 | 7/2007 | Yelland | |
| 2008/0105640 | A1 | 5/2008 | Ott | |
| 2008/0185384 | A1 | 8/2008 | Bolli | |
| 2009/0236304 | A1 | 9/2009 | Watson | |
| 2009/0302037 | A1 | 12/2009 | Rigling | |
| 2010/0237073 | A1 | 9/2010 | Alther et al. | |
| 2010/0326948 | A1 | 12/2010 | Campbell | |
| 2011/0000871 | A1 | 1/2011 | Bernard et al. | |
| 2011/0174760 | A1 | 7/2011 | Luzzato et al. | |
| 2012/0024815 | A1 | 2/2012 | Kwon | |
| 2012/0298666 | A1 | 11/2012 | Kwon | |
| 2013/0001184 | A1 | 1/2013 | Groubert | |
| 2013/0001185 | A1 | 1/2013 | Antier et al. | |
| 2015/0144630 | A1 | 5/2015 | Backes et al. | |
| 2015/0259109 | A1 | 9/2015 | Vetten et al. | |
| 2018/0118423 | A1 | 5/2018 | Bois et al. | |
| 2018/0186505 | A1 | 7/2018 | Peterges et al. | |
| 2018/0370701 | A1 | 12/2018 | Maguire | |
| 2019/0106246 | A1 | 4/2019 | Kendall | |
| 2019/0344933 | A1 | 11/2019 | Kim | |
| 2019/0344944 | A1 | 11/2019 | Maguire | |
| 2019/0375555 | A1 | 12/2019 | Edie et al. | |
| 2020/0017260 | A1 | 1/2020 | Migas et al. | |
| 2020/0115115 | A1 | 4/2020 | Migas et al. | |
| 2020/0207525 | A1 | 7/2020 | Sung | |
| 2020/0283201 | A1 | 9/2020 | Migas et al. | |
| 2020/0369446 | A1 | 11/2020 | Melan-Moutet | |
| 2020/0377259 | A1 | 12/2020 | Reisert et al. | |
| 2020/0407124 | A1 | 12/2020 | Caszatt et al. | |
| 2021/0039838 | A1 | 2/2021 | Hanan | |
| 2021/0094733 | A1 | 4/2021 | Bloom et al. | |
| 2021/0094736 | A1 | 4/2021 | Maguire | |
| 2021/0179324 | A1 | 6/2021 | Hanan | |
| 2021/0188488 | A1 | 6/2021 | Dreyer et al. | |
| 2021/0221572 | A1* | 7/2021 | Migas | B65D 41/3428 |
| 2021/0300648 | A1* | 9/2021 | Bassi | B65D 41/34 |
| 2022/0371785 | A1* | 11/2022 | Lohrman | B65D 55/16 |
| 2023/0145263 | A1* | 5/2023 | Lohrman | B65D 41/0428 215/235 |

FOREIGN PATENT DOCUMENTS

| | | |
|---|---|---|
| CN | 1830730 | 9/2006 |
| CN | 201209040 | 3/2009 |
| CN | 102700823 | 10/2012 |
| DE | 9318243 | 2/1994 |
| DE | 4123732 | 8/1998 |
| DE | 102009010681 | 1/2010 |
| DE | 202019106993 | 1/2020 |
| DE | 202019106992 | 2/2020 |
| DE | 102018128886 | 7/2020 |
| DE | 102018130541 | 7/2020 |
| DE | 102019132541 | 11/2020 |
| DE | 102020107184 | 5/2021 |
| DE | 102019132538 | 6/2021 |
| DE | 202021103289 | 8/2021 |
| EP | 1529736 | 5/2005 |
| EP | 1961669 | 8/2008 |
| EP | 3081505 | 10/2016 |
| EP | 3135600 | 3/2017 |
| EP | 3336003 | 6/2018 |
| EP | 3584190 | 12/2019 |
| EP | 3715275 | 9/2020 |
| EP | 3715276 | 9/2020 |
| EP | 3766797 | 1/2021 |
| EP | 3798150 | 3/2021 |
| EP | 3831736 | 6/2021 |
| ES | 1266291 | 4/2021 |
| FR | 2953202 | 6/2011 |
| FR | 3084881 | 2/2020 |
| FR | 3093709 | 9/2020 |
| JP | 11-500091 | 1/1999 |
| JP | 2001019002 | 1/2001 |
| JP | 2004307006 | 11/2004 |
| JP | 2005041566 | 2/2005 |
| JP | 2005289488 | 10/2005 |
| JP | 4906441 | 3/2008 |
| JP | 2011-201559 | 10/2011 |
| JP | 2014-061929 | 4/2014 |
| JP | 5520768 | 6/2014 |
| JP | 5574582 | 8/2014 |
| JP | 5600461 | 10/2014 |
| KR | 20-0213792 | 2/2001 |
| KR | 10-0855086 | 8/2008 |
| KR | 20080093839 | 10/2008 |
| KR | 10-0872159 | 1/2009 |
| KR | 10-0942642 | 2/2010 |
| KR | 10-0981240 | 9/2010 |
| KR | 1017448460000 | 6/2017 |
| KR | 10-2195928 | 12/2020 |
| MX | 2007015318 | 2/2008 |
| WO | WO2002/062674 | 8/2002 |
| WO | WO2005/073098 | 8/2005 |
| WO | WO2008/142413 | 11/2008 |
| WO | WO2009/048273 | 4/2009 |
| WO | WO2015/061834 | 5/2015 |
| WO | WO2016/160591 | 10/2016 |
| WO | WO2019/031779 | 2/2019 |
| WO | WO2019/175740 | 9/2019 |
| WO | WO2019/177616 | 9/2019 |
| WO | WO2020/041640 | 2/2020 |

(56) References Cited

FOREIGN PATENT DOCUMENTS

| | | | | |
|---|---|---|---|---|
| WO | WO2020/050823 | | 3/2020 | |
| WO | WO2020/077162 | | 4/2020 | |
| WO | WO2020/093058 | | 5/2020 | |
| WO | WO2020/099516 | | 5/2020 | |
| WO | WO2020/156847 | | 8/2020 | |
| WO | WO2020/157695 | | 8/2020 | |
| WO | WO2020/182854 | | 9/2020 | |
| WO | WO2020/201227 | | 10/2020 | |
| WO | WO2020/212426 | | 10/2020 | |
| WO | WO2020/227813 | | 11/2020 | |
| WO | WO2021/005428 | | 1/2021 | |
| WO | WO2021/005505 | | 1/2021 | |
| WO | WO2021/013370 | | 1/2021 | |
| WO | WO2021/014287 | | 1/2021 | |
| WO | WO-2021014290 | A1 * | 1/2021 | ..... B26D 1/0006 |
| WO | WO2021/018740 | | 2/2021 | |
| WO | WO2021/018772 | | 2/2021 | |
| WO | WO2021/018775 | | 2/2021 | |
| WO | WO2021/019419 | | 2/2021 | |
| WO | WO2021/021095 | | 2/2021 | |
| WO | WO2021/046413 | | 3/2021 | |
| WO | WO2021/053488 | | 3/2021 | |
| WO | WO2021/067412 | | 4/2021 | |
| WO | WO2021/068058 | | 4/2021 | |
| WO | WO2021/074726 | | 4/2021 | |
| WO | WO2021/074727 | | 4/2021 | |
| WO | WO2021/074728 | | 4/2021 | |
| WO | WO2021/080550 | | 4/2021 | |
| WO | WO2021/099323 | | 5/2021 | |
| WO | WO2021/099358 | | 5/2021 | |

OTHER PUBLICATIONS

International Search Report and Written Opinion for International Application No. PCT/US2020/049459, dated Dec. 8, 2020, 13 pages.

International Search Report and Written Opinion for International Application No. PCT/US2020/049453, dated Dec. 14, 2020, 13 pages.

International Search Report and Written Opinion of International Application No. PCT/US2023/062209, dated May 30, 2023, 14 pages.

* cited by examiner

TETHERED, HINGED CLOSURE WITH MODIFIED PRIMARY SLIT

CROSS-REFERENCE TO RELATED PATENT APPLICATIONS

The present application is a continuation of International Application No. PCT/US2023/062209, filed Feb. 8, 2023, which claims the benefit of and priority to U.S. Provisional Application No. 63/309,126, filed on Feb. 11, 2022, each of which is incorporated herein by reference in its entirety.

BACKGROUND OF THE INVENTION

The present disclosure relates generally to the field of closures for containers. The present disclosure relates specifically to a closure for a container having a cap and a tab, with the tab maintaining the cap in an open position.

SUMMARY OF THE INVENTION

One embodiment of the invention relates to a closure including a top panel including an upper surface and a lower surface, a rotational axis about which the top panel is centered, a cylindrical wall extending from the lower surface of the top panel to a bottom edge of the cylindrical wall, an inner surface of the cylindrical wall facing towards the rotational axis, a retention band pivotally coupled to the cylindrical wall, a first line of weakness that separates the cylindrical wall and the retention band, a second line of weakness that extends circumferentially with respect to the rotational axis, a first tether that couples the cylindrical wall to the retention band, and a second tether that couples the cylindrical wall to the retention band. The retention band is attached to the bottom edge by a plurality of frangible members, the frangible members providing a visual indication, when broken, that the closure has been opened. The plurality of frangible members extend across the first line of weakness and connect the cylindrical wall and the retention band. The first line of weakness extends circumferentially with respect to the rotational axis from a first end to a second end such that the first end and the second end are separated by a first angle with respect to the rotational axis, and the first angle is between 12 degrees and 30 degrees. The second line of weakness is distinct from the first line of weakness. The first tether extends between the second line of weakness and the first end of the first line of weakness, and the second tether extends between the second line of weakness and the second end of the first line of weakness.

Another embodiment of the invention relates to a closure including a top panel including an upper surface and a lower surface, a rotational axis about which the top panel is centered, a cylindrical wall extending from the lower surface of the top panel to a bottom edge of the cylindrical wall, an inner surface of the cylindrical wall facing towards the rotational axis, a retention band pivotally coupled to the cylindrical wall, the retention band attached to the bottom edge by a plurality of frangible members, the frangible members providing a visual indication, when broken, that the closure has been opened, a first line of weakness that separates the cylindrical wall and the retention band, a second line of weakness extending circumferentially with respect to the rotational axis from a third end to a fourth end, a first tether that couples the cylindrical wall to the retention band, and a second tether that couples the cylindrical wall to the retention band. The plurality of frangible members extend across the first line of weakness and connect the cylindrical wall and the retention band. The first line of weakness extends circumferentially with respect to the rotational axis from a first end to a second end such that the first end and the second end are separated by a first acute angle with respect to the rotational axis. The second line of weakness is distinct from the first line of weakness, the third end and the fourth end are separated by a second acute angle with respect to the rotational axis, and a ratio of the first angle to the second angle is between 1:4 and 1:6. The first tether extends between the second line of weakness and the first end of the first line of weakness, and the second tether extends between the second line of weakness and the second end of the first line of weakness.

Another embodiment of the invention relates to a closure including a top panel including an upper surface and a lower surface, a rotational axis about which the top panel is centered, a cylindrical wall extending from the lower surface of the top panel to a bottom edge of the cylindrical wall, an inner surface of the cylindrical wall facing towards the rotational axis, a retention band pivotally coupled to the cylindrical wall, the retention band attached to the bottom edge by a plurality of frangible members, the frangible members providing a visual indication, when broken, that the closure has been opened, a first line of weakness that separates the cylindrical wall and the retention band, a second line of weakness extending circumferentially from a third end to a fourth end with respect to the rotational axis, a tab that extends from the cylindrical wall, a first tether that couples the cylindrical wall to the retention band, and a second tether that couples the cylindrical wall to the retention band. The plurality of frangible members extend across the first line of weakness and connect the cylindrical wall and the retention band. The first line of weakness extends circumferentially with respect to the rotational axis from a first end to a second end such that the first end and the second end are separated by a first acute angle with respect to the rotational axis. The second line of weakness is distinct from the first line of weakness, and the third end and the fourth end define a second acute angle with respect to the rotational axis. The tab is defined by the second line of weakness, and the tab is configured to interface against a container neck of a container subsequent to the closure being opened, thereby biasing the cylindrical wall from the container neck. The tab includes an upper portion and a lower portion that is further from the top panel than the upper portion. The lower portion of the tab extends circumferentially a third acute angle with respect to the rotational axis, and the third acute angle is greater than the first acute angle. The first tether extends between the second line of weakness and the first end of the first line of weakness, and the second tether extends between the second line of weakness and the second end of the first line of weakness.

Additional features and advantages will be set forth in the detailed description which follows, and in part will be readily apparent to those skilled in the art from the description or recognized by practicing the embodiments as described in the written description and claims hereof, as well as the appended drawings. It is to be understood that both the foregoing general description and the following detailed description are exemplary.

The accompanying drawings are included to provide a further understanding and are incorporated in and constitute a part of this specification. The drawings illustrate one or more embodiments and together with the description serve to explain principles and operation of the various embodiments.

DETAILED DESCRIPTION

Referring generally to the figures, various embodiments of a closure are shown. Closures are generally used to enclose contents, such as containers. For example, closures are used to enclose liquids inside liquid-containing containers, such as water bottles. The present application provides a closure with a tether and hinge formation that permits the body of the closure to remain coupled to the container even after the closure is opened.

In various embodiments, the closure(s) described herein provide a tether structure to couple the closure body to a retaining band, which remains coupled to the container. The closure also includes a tab formation that facilitates users drinking contents from the container. In particular, the tab biases the body of the closure away from the container neck when the closure is opened. Applicant has observed that providing an upper weakened portion (e.g., upper slit) separated by a reduced angle, as described herein, provides improved performance benefits for the closure. For example, less force is required to pivot the closure open compared to closures with a wider angle between the ends of the upper weakened portion.

Figure 1:
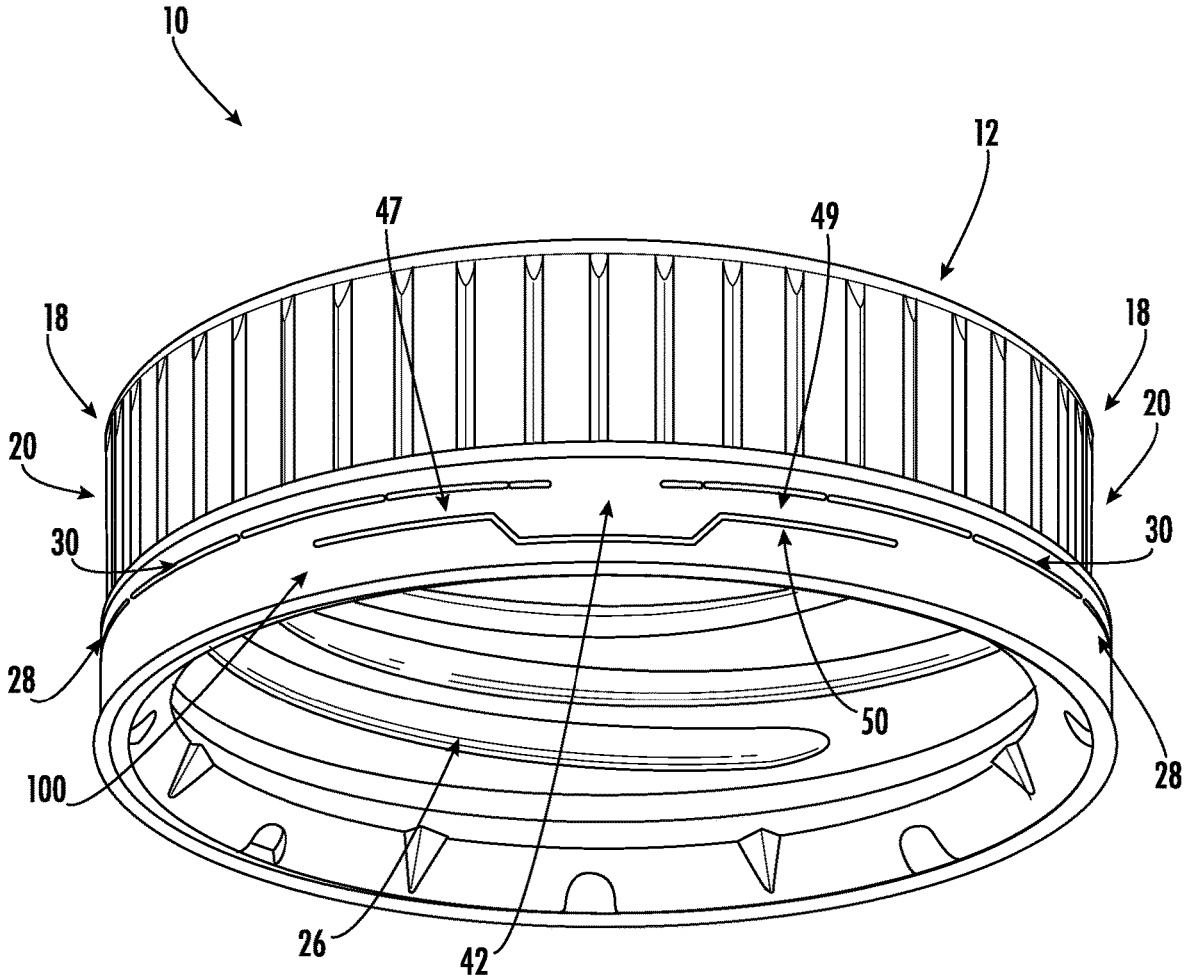
FIG. 1 is a perspective view of a closure, according to an exemplary embodiment.
Figure 2:
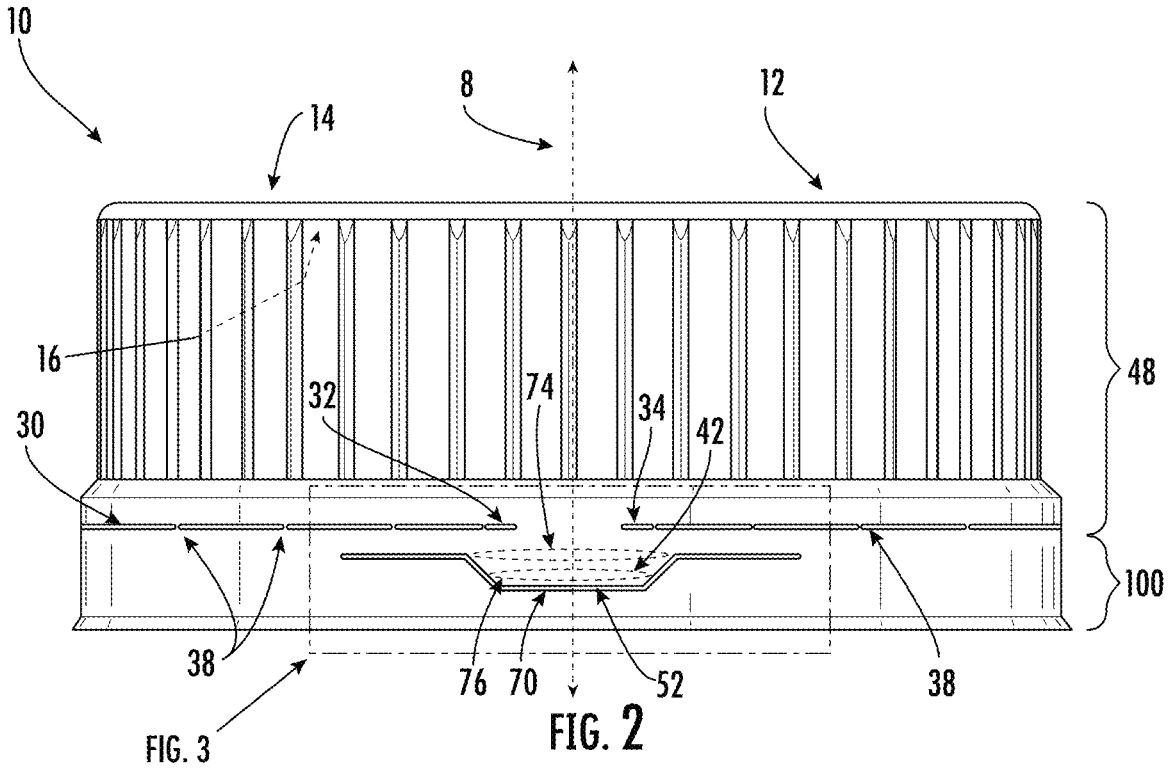
FIG. 2 is a back view of the closure of FIG. 1, according to an exemplary embodiment.
Figure 3:
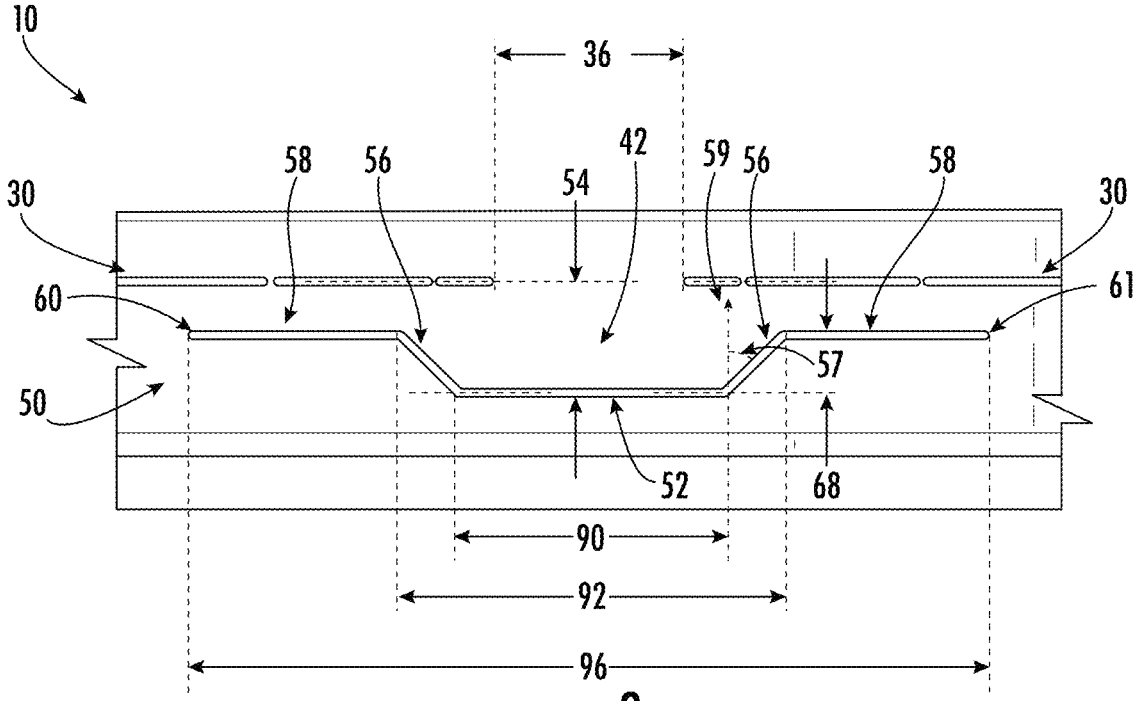
FIG. 3 is a detailed back view of the closure of FIG. 1, according to an exemplary embodiment.
Figure 4:
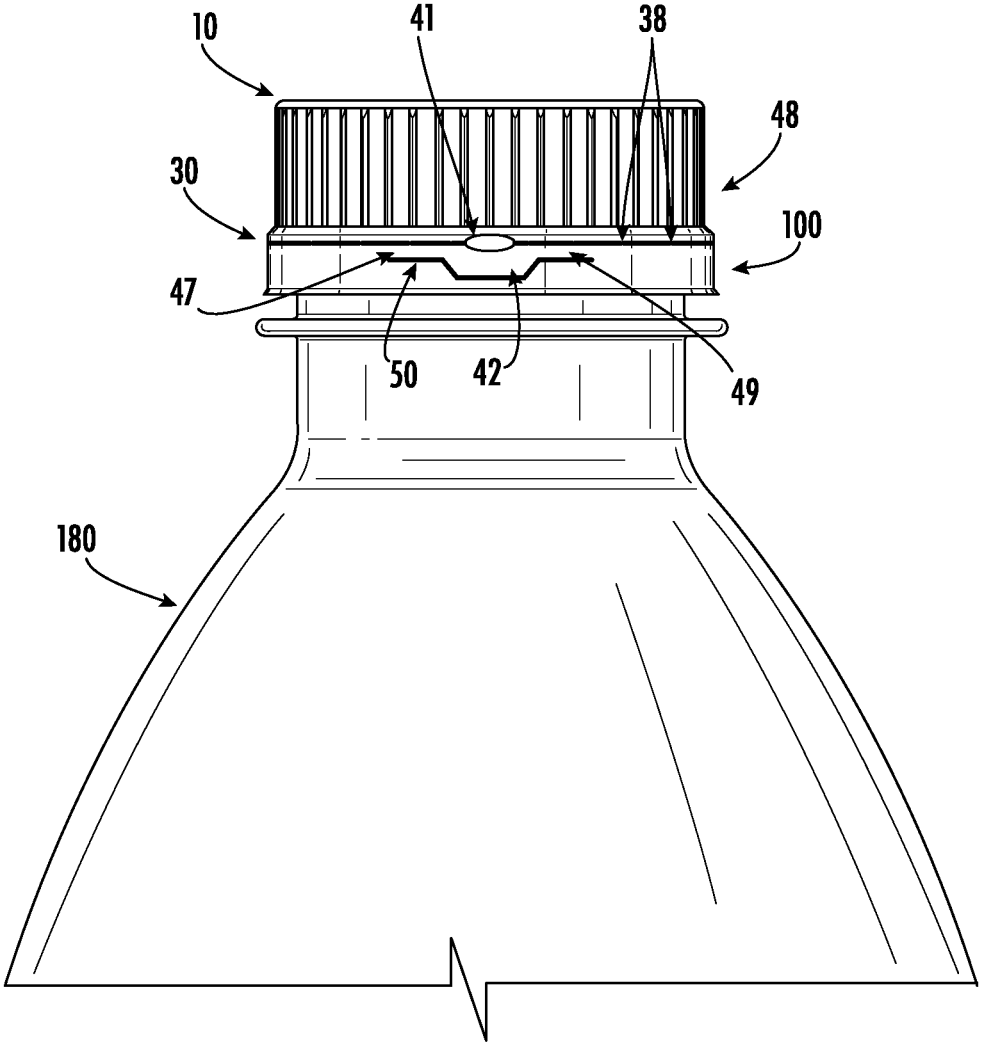
FIG. 4 is a back view of the closure of FIG. 1 on a container, according to an exemplary embodiment.

Referring first to FIGS. 1-3, in an embodiment, a closure 10 for closing a container 180 is shown. The closure 10 includes a top panel 12 and a cylindrical wall, shown as skirt 20, perpendicular to the top panel 12. Top panel 12 includes an upper surface 14 and an opposing lower surface 16. In various embodiments, closure 10 includes rotational axis 8 about which top panel 12 is centered. The skirt 20 extends downwardly from a lower surface 16 of an outer periphery 18 of top panel 12. The skirt extends away from opposing upper surface 14 of top panel 12 to a bottom edge 28 of skirt 20. Skirt 20 includes an inner surface 22 and an opposing outer surface 24, the inner surface 22 facing towards rotational axis 8 and outer surface facing away from rotational axis 8.

Closure 10 includes retention band 100 pivotally coupled to the skirt 20, the retention band 100 attached to the bottom edge 28 (of skirt 20) by a plurality of frangible members 38. The frangible members 38 provide a visual indication, when broken, that the closure 10 has been opened.

Closure 10 includes a first line of weakness, such as an upper weakened section, shown as a upper slit 30, that separates skirt 20 and retention band 100. Upper slit 30 includes one or more frangible members 38 that couple body 48 to retention band 100. Stated another way, frangible members 38 extend across upper slit 30 to connect skirt 20 and retention band 100. When closure 10 is initially opened, frangible members 38 break, thus providing a visual indication that closure 10 has been opened. Upper slit 30 separates body 48 of closure 10 from a retention band, shown as retention band 100. Upper slit 30 extends circumferentially around closure 10 from first end 32 to second end 34.

Angle 36 is defined as angular separation of first end 32 from second end 34 with respect to rotational axis 8 of closure 10. Stated another way, first end 32 and second end 34 are separated by angle 36, such as angle 36, with respect to rotational axis 8. Angle 36 is smaller than angle of various othered tethered, hinged closures. Applicant has observed that angle 36 being smaller provides one or more unique performance aspects compared to closures with a wider angle 36. For example, closure 10 is easier to pivot open compared to other closures.

In various embodiments, angle 36 is between 10 degrees and 35 degrees, and more particularly between 12 degrees and 30 degrees, and more particularly 14 degrees and 26 degrees, and more particularly between 16 degrees and 22 degrees, and more particularly between 17 degrees and 19 degrees, and more specifically approximately 18 degrees (e.g., between 17.5 and 18.4 degrees, inclusively). In various embodiments, angle 36 is less than or equal to 40 degrees, and more particularly is less than or equal to 35 degrees, and is less than or equal to 30 degrees, and more particularly is less than or equal to 25 degrees, and more particularly is less than or equal to 20 degrees.

Closure 10 includes a second line of weakness, such as a lower weakened section, shown as lower slit 50, that extends circumferentially with respect to rotational axis 8 and is distinct from upper slit 30. Lower slit 50 together with upper slit 30 forms various features in closure 10. As is described in more detail below, tab 42 extends from body 48 of closure 10 towards retention band 100.

In various embodiments, closure 10 includes left tether 47 and right tether 49. Connecting portions, shown as left tether 47 and right tether 49, are defined between upper slit 30 and lower slit 50 and extend between body 48 and retention band 100. Left tether 47 extends between lower slit 50 and first end 32 of upper slit 30, and right tether 49 extends between lower slit 50 and second end 34 of upper slit 30.

As will be described in more detail below, when closure is opened for the first time, body 48 of closure 10 pivots around hinge 41 away from the container neck and the retention band 100. Body 48 remains coupled to retention band 100 via left tether 47 and right tether 49 after frangible members 38 are broken. As body 48 pivots away from the container neck, tab 42 pivots towards the container neck. Tab 42 is positionable to interface against the container neck and to bias body 48 of closure 10 away from the container neck, thus allowing a user to drink from the container neck with little to no interference from body 48 of closure 10.

Turning to FIGS. 2-3 in particular, in a specific embodiment lower slit 50 is formed by a series of portions that extend circumferentially around closure 10 at varying distances from top panel 12. Lower slit 50 includes a central portion 52 and side portions 56 that extend upward from central portion 52. In various embodiments, lower slit 50 includes lateral portions 58 extending circumferentially away from side portions 56, and lateral portions 58 are closer to top panel 12 than central portion 52.

In various embodiments, side portions 56 define angle 57 with respect to line 59 parallel to rotational axis 8. In various embodiments, angle 57 is between 20 degrees and 70 degrees, and more specifically between 30 degrees and 60 degrees, and even more specifically between 40 degrees and 50 degrees, and even more specifically 45 degrees.

Tab 42 includes an upper portion 74 and a lower portion 76 that is further from top panel 12 than upper portion 74. For example, upper portion 74 is the top-most portion of tab 42 (e.g., between the top edges of connecting portions 56), and lower portion 76 is the bottom-most portion of tab 42 (e.g., between the bottom edges of connecting portions 56). Lower portion 76 defines an interfacing surface 70 that interfaces against the container neck (e.g., neck 182 of container 180) to bias closure 10 away from the opening of the container neck (e.g., opening 190 of neck 182 of container 180).

Upper portion 74 of tab 42 extends circumferentially around closure 10 with respect to rotational axis 8 and defines angle 92 with respect to rotational axis. In various embodiments, angle 36 is less than angle 92. In various embodiments, a ratio between angle 36 and angle 92 is between 1:1.5 and 1:2.8, and more specifically between 1:1.7 and 1:2.4, and more specifically between 1:1.8 and 1:2.2.

Lower portion 76 of tab 42 extends circumferentially around closure 10 with respect to rotational axis 8 and defines angle 90 with respect to rotational axis 8. In various embodiments, a ratio between angle 36 and angle 90 is between 1:1.1 and 1:2, and more specifically between 1:1.2 and 1:1.7, and more specifically between 1:1.3 and 1:1.6.

Closure 10 includes tab 42 extending away from the top panel 12 towards the retention band 100. Tab 42 is defined by the lower slit 50 and configured to interface against a container neck of a container (e.g., container neck 182 of container 180) subsequent to the closure 10 being opened, thereby biasing the top panel 12 away from the opening of the container neck (e.g., opening 190 of container neck 182 of container 180).

In a specific embodiment, tab 42 of lower slit 50 is defined by central portion 52 and connecting portions 56. Central portion 52 is a distance 54 from upper slit 30. Connecting portions 56 of lower slit 50 extend from either end of central portion 52 towards lateral portions 58. Lateral portions 58 extend circumferentially about closure. In a specific embodiment, lateral portions 58 are a smaller distance from top panel 12 than central portion 52. In a specific embodiment, lateral portions 58 are between first end 32 and second end 34 of upper slit 30. In various embodiments, lateral portions 58 are height 68 above central portion 52.

Lower slit 50 extends angle 96 circumferentially around closure 10 with respect to axis 8. Central portion 52 extends angle 90 circumferentially around closure 10 with respect to axis 8. Central portion 52 and both connecting portions 56 collectively extend angle 92 circumferentially around closure 10 with respect to axis 8.

In various embodiments, a ratio of angle 36 of upper slit 30 to angle 96 of lower slit 50 is between 1:3 and 1:8, and more specifically between 1:4 and 1:6, and more specifically between 1:45 and 1.55, and more specifically is 1:5. Applicant has observed that these ratios between angle 36 and angle 96 provide an improved performance of closure 10 with respect to permitting body 48 to rotate while still maintaining a sufficiently strong connection between body 48 and retention band 100.

In various embodiments, lower slit 50 extends from first end 60 to second end 61, and thus extends and defines angle 96 with respect to rotational axis 8. In various embodiments, angle 96 is between 45 degrees and 65 degrees, and more specifically is between 50 degrees and 60 degrees, and even more specifically is between 52 degrees and 59 degrees, and even more specifically is 56 degrees. In various embodiments, angle 90, 92, and 96 are acute angles.

In various embodiments, tab 42 is considered to extend around closure 10 angle 90 or angle 92. In various embodiments, tab 42 extends around closure 10 less than upper slit 30. For example, angle 90 and/or angle 92 are greater than angle 36. In various embodiments, angle 92 greater than angle 90.

In various embodiments, lower slit 50 does not include frangible members 38. In various other embodiments, lower slit 50 includes frangible members 38.

In various embodiments, no frangible members 38 are above lower slit 50. Stated another way, in various embodiments for the entirety of lower slit 50 there is not a frangible connection vertically above the lower slit 50 when closure 10 is arranged in the upright position (FIG. 2).

Referring to FIGS. 4-12, various aspects of closure 10 are shown. Closure 10 is configured to be affixed to container neck 182 of container 180 such that retention band 100 is configured to remain coupled to container 180 after closure 10 has been opened.

Figure 6:
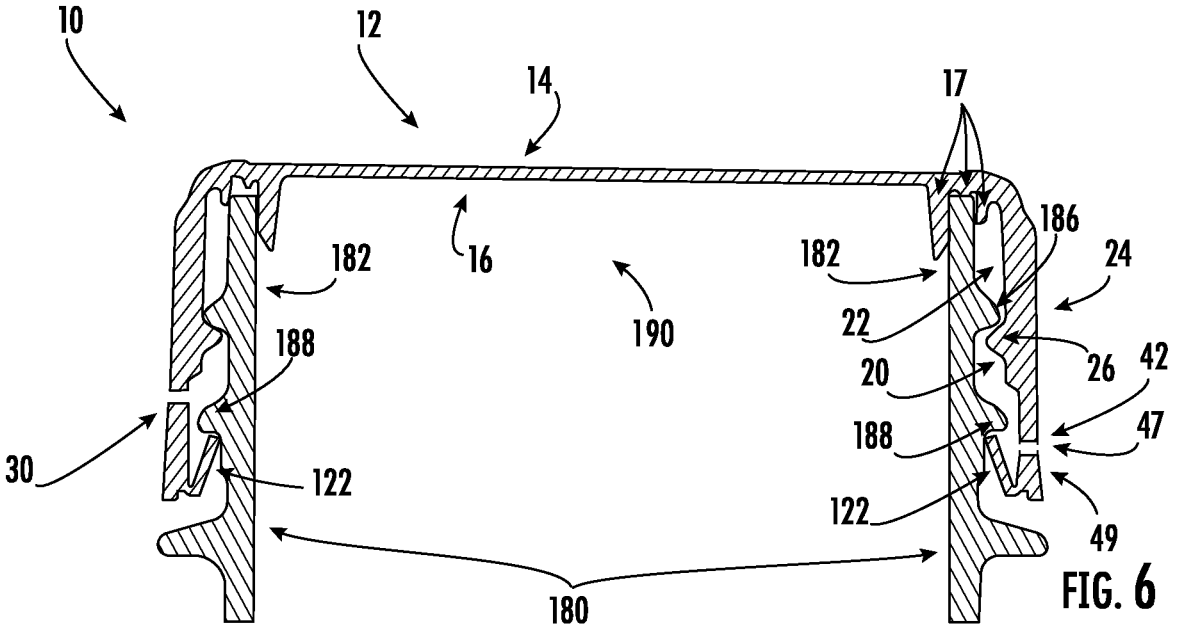
FIG. 6 is a cross-section view of the closure of FIG. 5 on a container taken along line 6-6 in FIG. 5, according to an exemplary embodiment.

Turning to FIG. 6, the interaction between the J-band and the container neck will be described. The container 180 includes a neck portion 182 defining an opening to the container 180. The neck portion 182 includes a mating sealing formation/neck thread 186. The skirt 20 includes an inner surface 22 having a sealing/mating formation, shown as thread 26, to mate with the mating sealing formation/neck thread 186 of container 180. Skirt 20 also includes an outer surface 24 facing away from axis 8 and opposite inner surface 22. The closure 10 includes one or more sealing formations, shown as rings 17, that interface with neck portion 182 of container 180 to provide a fluid seal between closure 10 and container 180.

A retaining tamper-evidencing band, shown as retention band 100, includes at least one radially inwardly projecting retaining element, shown as a J-band 122. J-band 122 is attached at a lower end to the inner surface of the tamper band via a J-band hinge. An upper, free end of the J-band is defined by an engagement surface. The retaining elements include a plurality of structures (e.g. beads, tabs, flanges) projecting radially inwards from the inner surface of retention band 100 and engaging a corresponding retaining structure, such as annular projection 188 that extends from neck portion 182 of container 180.

When the closure 10 is applied to the neck portion 182 of the container 180, the sealing formation/mating thread 186 of container 180 engages the mating sealing formation/neck thread 26 of closure 10. One or more of rings 17 engage the mating attachment formation of container neck 182 to seal the container 180. When the closure 10 is removed from the neck portion 182, most or all of the frangible members 38 are broken, and the retention band 100 remains engaged with the container neck 182. The body 48 of closure 10 remains attached to the retention band 100 via left tether 47 and right tether 49. The tab 42 interacts with the mating attachment formation to maintain an open cap position wherein the body 48 of closure 10 is retained displaced from the opening of the container 180. In a specific embodiment, when body 48 of closure 10 is removed from neck portion 182, at least one of frangible members 38 break while at least one of frangible members 38 remain unbroken.

The tab 42 interacts with the mating attachment formation/engagement ring of the container neck to maintain an open cap position wherein the body 48 of closure 10 is retained displaced from the opening of the container 180. The left tether 47 and right tether 49 bias the tab 42 inward towards the neck portion 182 of the container 180, working together with the tab 42 to keep the body 48 in the open cap position on an angle θ (e.g., from 90° to 135°). In a specific embodiment, the tab 42 contacts the neck thread 26 while the body 48 is in the open cap position.

Figure 5:
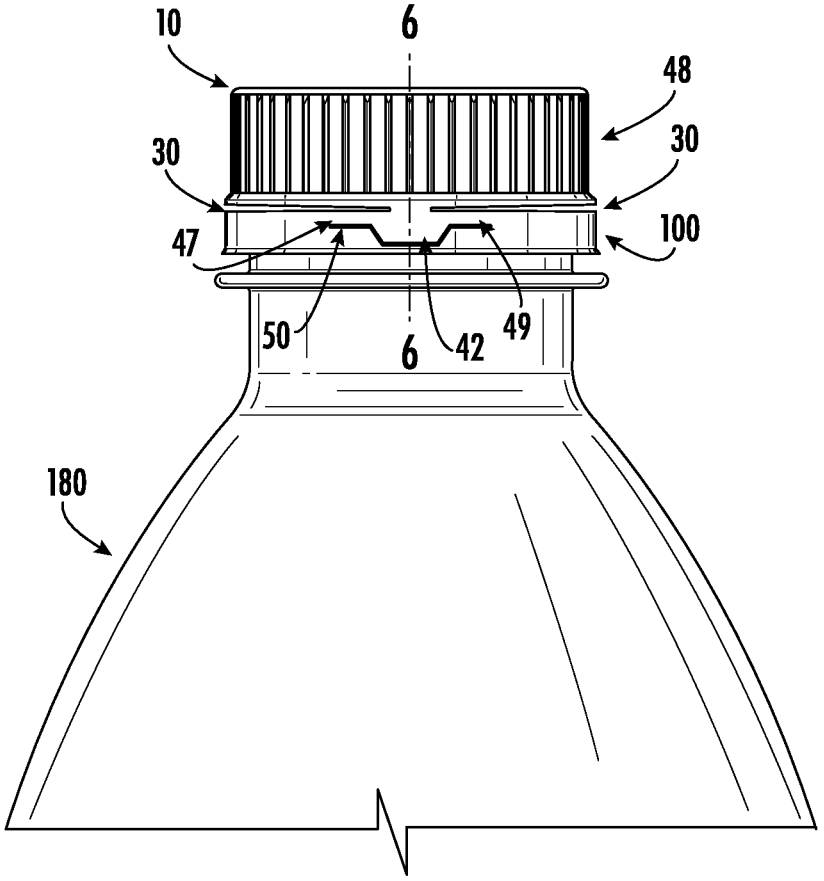
FIG. 5 is a back view of the closure of FIG. 1 on a container shown in a different configuration than shown in FIG. 4, according to an exemplary embodiment.

Turning to FIGS. 5-12, the opening of closure 10 relative to neck portion 182 of container 180 is depicted. FIGS. 5-6 depict closure 10 at the moment that most and/or all of frangible members 38 have broken. Sealing rings 17 of body 48 are still sealed with neck portion 182. FIG. 6 depicts a cross-section of the portion of closure 10 and container 180 identified in FIG. 5. Left tether 47 and right tether 49 are shown in dotted line in FIG. 6, because they are not located along the cross-section line identified in FIG. 5. Left tether 47 and right tether 49 are located to either side of the cross-section line identified in FIG. 5.

Figure 7:
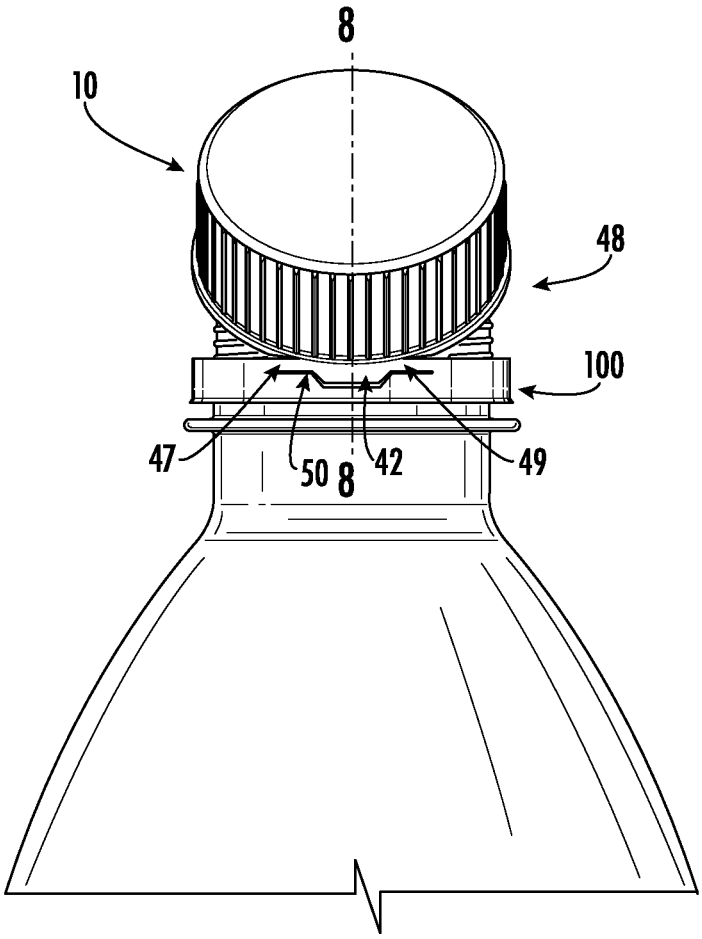
FIG. 7 is a back view of the closure of FIG. 1 on a container shown in a different configuration than shown in FIG. 5, according to an exemplary embodiment.
Figure 8:
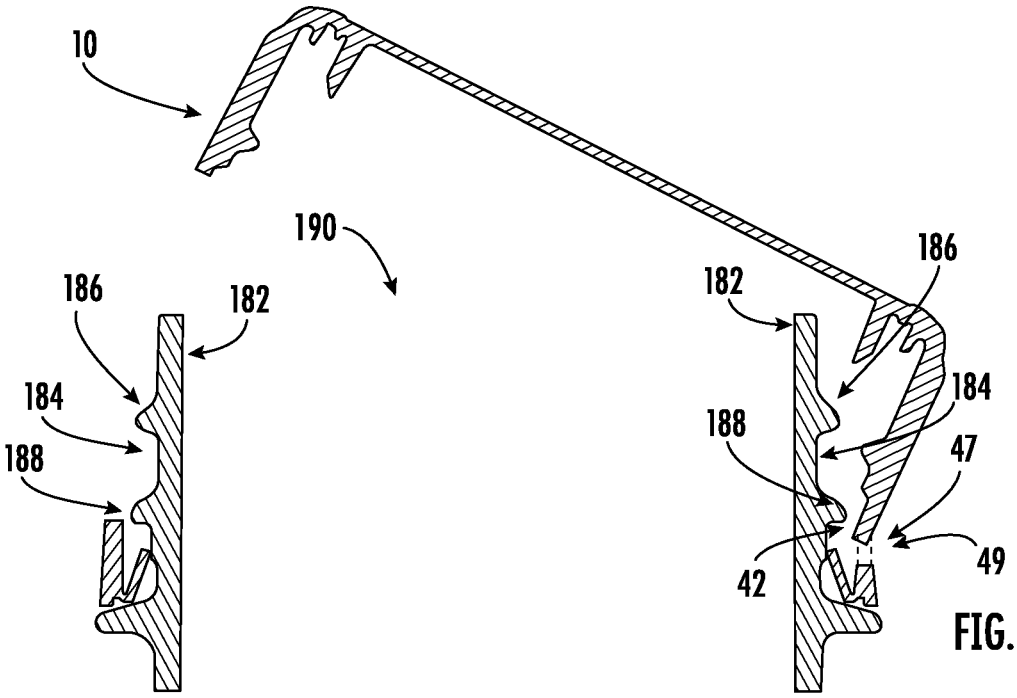
FIG. 8 is a cross-section view of the closure of FIG. 7 on a container taken along line 8-8 in FIG. 7, according to an exemplary embodiment.

Turning to FIGS. 7-8, body 48 of closure 10 is starting to pivot away from neck portion 182 of container 180. Body 48 remains coupled to retention ring 100 via left tether 47 and right tether 49. Similar to FIGS. 5-6, left tether 47 and right tether 49 retain the coupling between body 48 and retention band 100 and are shown in dotted line in FIG. 8. Tab 42 is starting to pivot towards container 180 but not yet interfacing with container 180.

Figure 9:
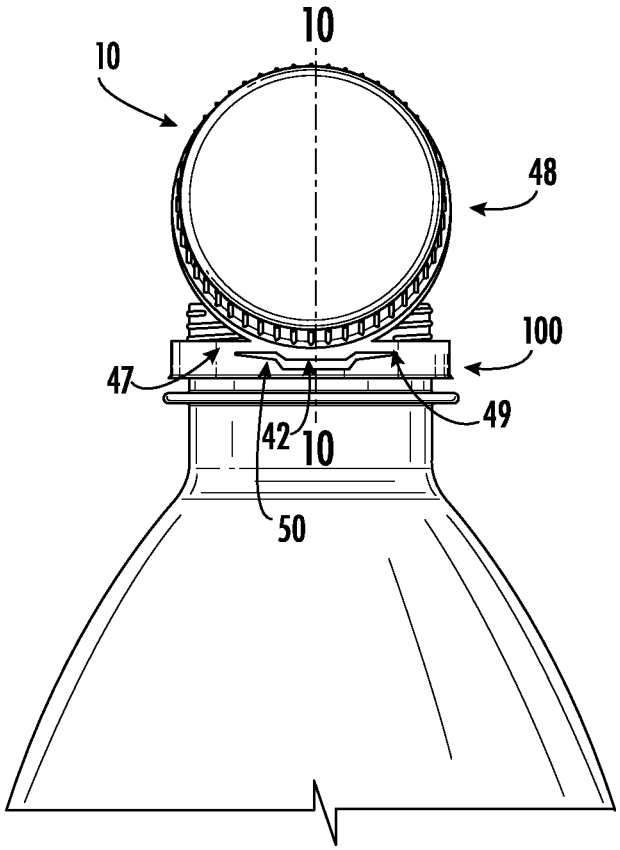
FIG. 9 is a back view of the closure of FIG. 1 on a container shown in a different configuration than shown in FIG. 7, according to an exemplary embodiment.
Figure 10:
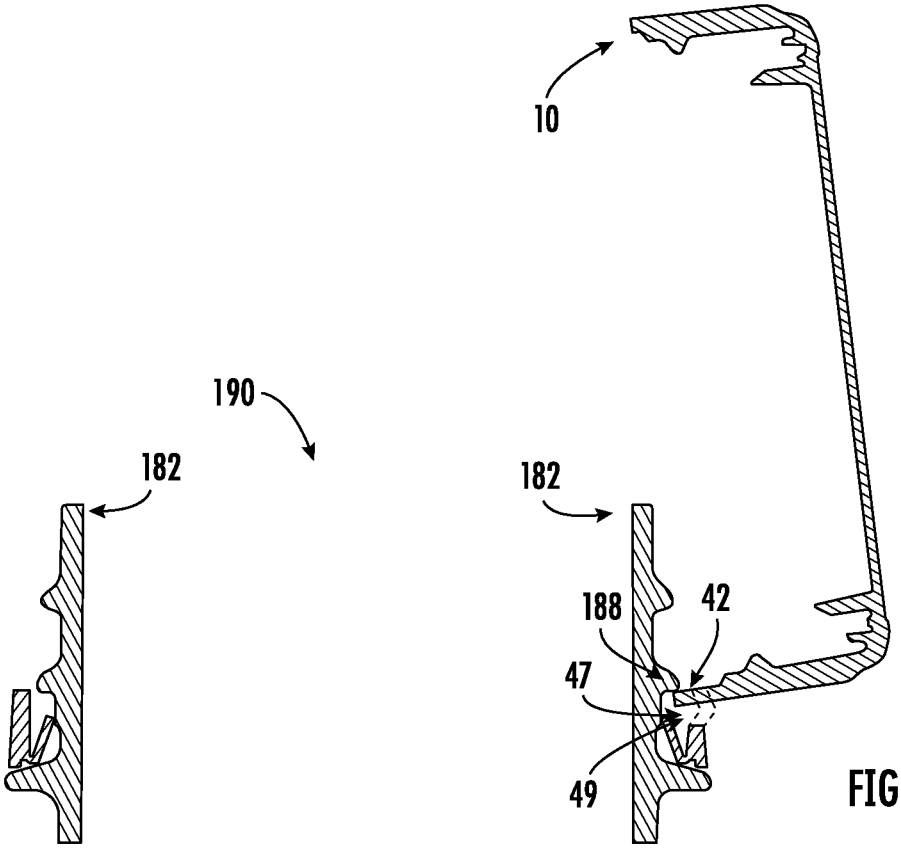
FIG. 10 is a cross-section view of the closure of FIG. 9 on a container taken along line 10-10 in FIG. 9, according to an exemplary embodiment.

Turning to FIGS. 9-10, body 48 of closure 10 is pivoted approximately halfway open from neck portion 182. Tab 42 is now interfacing against the bottom of annular projection 188 of container 180. Similar to FIGS. 5-8, left tether 47 and right tether 49 retain the coupling between body 48 and retention band 100 and are shown in dotted line in FIG. 10.

Figure 11:
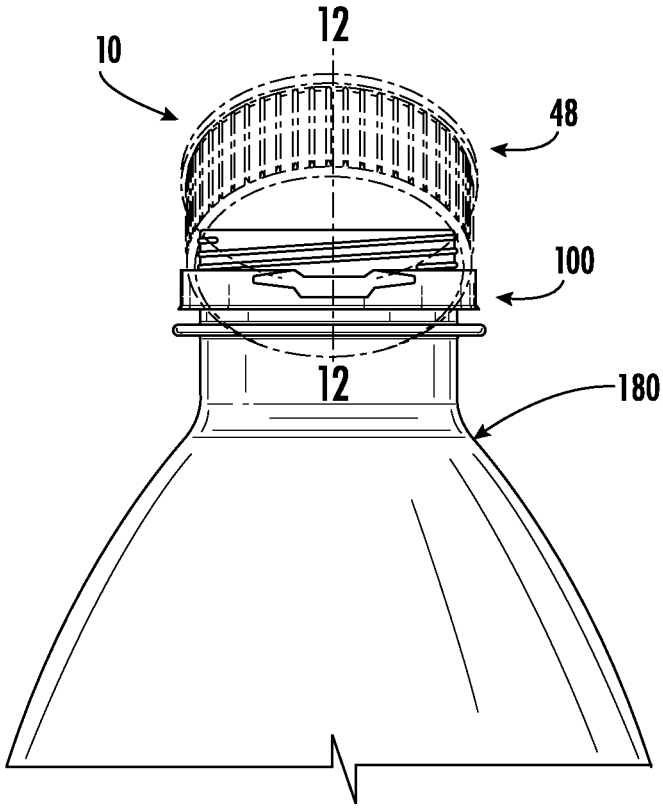
FIG. 11 is a back view of the closure of FIG. 1 on a container shown in a different configuration than shown in FIG. 9, according to an exemplary embodiment.
Figure 12:
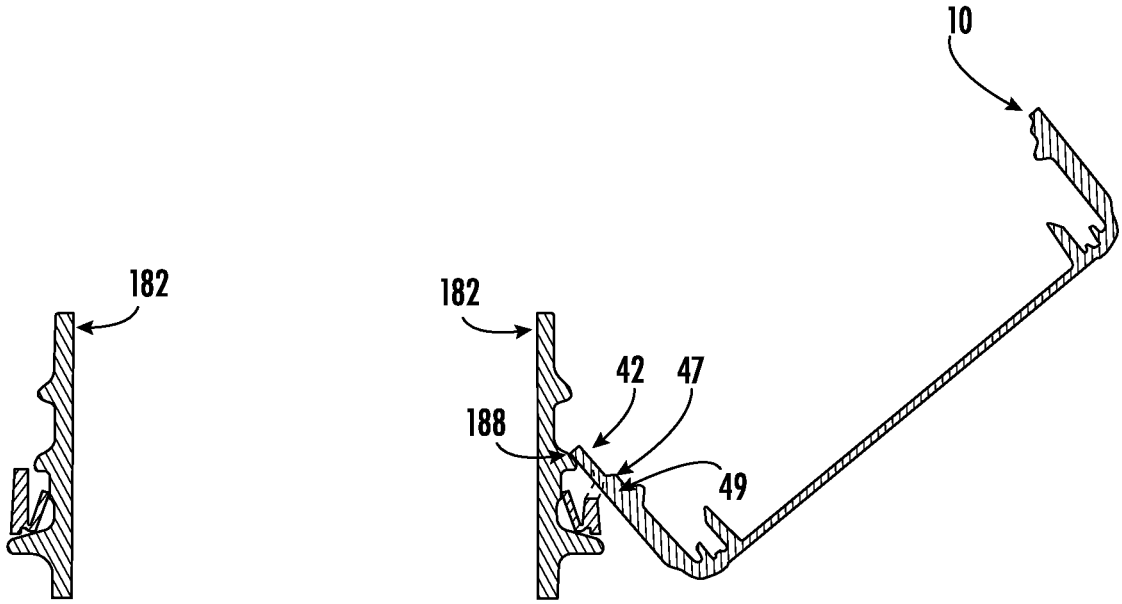
FIG. 12 is a cross-section view of the closure of FIG. 11 on a container taken along line 11-11 in FIG. 11, according to an exemplary embodiment.

Turning to FIGS. 11-12, body 48 of closure 10 is pivoted to the open position. Tab 42 is now interfacing against the upper portion of annular projection 188 of container 180. Tab 42 interfacing against annular projection 188 of container 180 biases body 48 of closure 10 away from neck portion 182. Similar to FIGS. 5-10, left tether 47 and right tether 49 retain the coupling between body 48 and retention band 100 and are shown in dotted line in FIG. 12 because they are not located along the cross-section line identified in FIG. 11.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein the article "a" is intended to include one or more than one component or element, and is not intended to be construed as meaning only one.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another, or with the two members and any additional member being attached to one another. Such joining may be permanent in nature or alternatively may be removable or releasable in nature. Various embodiments of the invention relate to any combination of any of the features, and any such combination of features may be claimed in this or future applications. Any of the features, elements, or components of any of the exemplary embodiments discussed above may be utilized alone or in combination with any of the features, elements, or components of any of the other embodiments discussed above.

In various exemplary embodiments, the relative dimensions, including angles, lengths and radii, as shown in the Figures are to scale. Actual measurements of the Figures will disclose relative dimensions, angles and proportions of the various exemplary embodiments. Various exemplary embodiments extend to various ranges around the absolute and relative dimensions, angles and proportions that may be determined from the Figures. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description. In addition, in various embodiments, the present disclosure extends to a variety of ranges (e.g., plus or minus 30%, 20%, or 10%) around any of the absolute or relative dimensions disclosed herein or determinable from the Figures.

What is claimed is:

1. A closure comprising:

a top panel including an upper surface and a lower surface;

a rotational axis about which the top panel is centered;

a cylindrical wall extending from the lower surface of the top panel to a bottom edge of the cylindrical wall;

an inner surface of the cylindrical wall facing towards the rotational axis;

a retention band pivotally coupled to the cylindrical wall, the retention band attached to the bottom edge by a plurality of frangible members, the plurality of frangible members providing a visual indication, when broken, that the closure has been opened;

a first line of weakness that separates the cylindrical wall and the retention band, wherein the plurality of frangible members extend across the first line of weakness and connect the cylindrical wall and the retention band, the first line of weakness extending more than 180 degrees circumferentially with respect to the rotational axis from a first end to a second end, wherein the first end and the second end are separated by a first angle with respect to the rotational axis, wherein the first angle is between 12 degrees and 30 degrees;

a second line of weakness that extends less than 180 degrees circumferentially with respect to the rotational axis, wherein the second line of weakness is distinct from the first line of weakness;

a first tether that couples the cylindrical wall to the retention band, wherein the first tether extends between the second line of weakness and the first end of the first line of weakness; and a second tether that couples the cylindrical wall to the retention band, wherein the second tether extends between the second line of weakness and the second end of the first line of weakness.

2. The closure of claim 1, wherein the closure is configured to be affixed to a container neck of a container, and wherein the retention band is configured to remain coupled to the container after the closure has been opened.

3. The closure of claim 1, comprising a tab extending away from the top panel towards the retention band, the tab defined by the second line of weakness and configured to interface against a container neck of a container subsequent to the closure being opened, thereby biasing the top panel away from the container neck.

4. The closure of claim 3, the second line of weakness comprising a central portion and side portions that extend upward from the central portion.

5. The closure of claim 4, the second line of weakness comprising lateral portions extending circumferentially away from the side portions, wherein the lateral portions are closer to the top panel than the central portion.

6. The closure of claim 3, wherein the closure is configured to be affixed to a container neck of a container, wherein the retention band is configured to remain coupled to the container after the closure has been opened, the tab comprising an upper portion and a lower portion that is further from the top panel than the upper portion, the lower portion defining an interfacing surface that interfaces against the container neck to bias the top panel away from an opening of the container neck.

7. A closure comprising:

a top panel including an upper surface and a lower surface;

a rotational axis about which the top panel is centered;

a cylindrical wall extending from the lower surface of the top panel to a bottom edge of the cylindrical wall;

an inner surface of the cylindrical wall facing towards the rotational axis;

a retention band pivotally coupled to the cylindrical wall, the retention band attached to the bottom edge by a plurality of frangible members, the plurality of frangible members providing a visual indication, when broken, that the closure has been opened;

a first line of weakness that separates the cylindrical wall and the retention band, wherein the plurality of frangible members extend across the first line of weakness and connect the cylindrical wall and the retention band, the first line of weakness extending circumferentially with respect to the rotational axis from a first end to a second end, wherein the first end and the second end are separated by a first angle with respect to the rotational axis, wherein the first angle is between 12 degrees and 30 degrees;

a second line of weakness that extends circumferentially with respect to the rotational axis, wherein the second line of weakness is distinct from the first line of weakness, the second line of weakness comprising a central portion and side portions that extend upward from the central portion, the second line of weakness comprising lateral portions extending circumferentially away from the side portions, wherein the lateral portions are closer to the top panel than the central portion, wherein the side portions define an angle between 30 degrees and 60 degrees with respect to a line parallel to the rotational axis;

a first tether that couples the cylindrical wall to the retention band, wherein the first tether extends between the second line of weakness and the first end of the first line of weakness; and a second tether that couples the cylindrical wall to the retention band, wherein the second tether extends between the second line of weakness and the second end of the first line of weakness.

8. A closure comprising:

a top panel including an upper surface and a lower surface;

a rotational axis about which the top panel is centered;

a cylindrical wall extending from the lower surface of the top panel to a bottom edge of the cylindrical wall;

an inner surface of the cylindrical wall facing towards the rotational axis;

a retention band pivotally coupled to the cylindrical wall, the retention band attached to the bottom edge by a plurality of frangible members, the plurality of frangible members providing a visual indication, when broken, that the closure has been opened;

a first line of weakness that separates the cylindrical wall and the retention band, wherein the plurality of frangible members extend across the first line of weakness and connect the cylindrical wall and the retention band, the first line of weakness extending circumferentially with respect to the rotational axis from a first end to a second end, wherein the first end and the second end are separated by a first angle with respect to the rotational axis, wherein the first angle is between 12 degrees and 30 degrees;

a second line of weakness that extends circumferentially with respect to the rotational axis, wherein the second line of weakness is distinct from the first line of weakness;

a first tether that couples the cylindrical wall to the retention band, wherein the first tether extends between the second line of weakness and the first end of the first line of weakness; and a second tether that couples the cylindrical wall to the retention band, wherein the second tether extends between the second line of weakness and the second end of the first line of weakness; and a tab extending away from the top panel towards the retention band, the tab defined by the second line of weakness and configured to interface against a container neck of a container subsequent to the closure being opened, thereby biasing the top panel away from the container neck, wherein the upper portion of the tab extends circumferentially with respect to the rotational axis and defines a second angle with respect to the rotational axis, wherein the first angle is less than the second angle;

wherein the closure is configured to be affixed to a container neck of a container, wherein the retention band is configured to remain coupled to the container after the closure has been opened, the tab comprising an upper portion and a lower portion that is further from the top panel than the upper portion, the lower portion defining an interfacing surface that interfaces against the container neck to bias the top panel away from an opening of the container neck.

9. The closure of claim 8, wherein a ratio of the first angle to the second angle is between 1:1.7 and 1:2.4.

10. A closure comprising:

a top panel including an upper surface and a lower surface;

a rotational axis about which the top panel is centered;

a cylindrical wall extending from the lower surface of the top panel to a bottom edge of the cylindrical wall;

an inner surface of the cylindrical wall facing towards the rotational axis;

a retention band pivotally coupled to the cylindrical wall, the retention band attached to the bottom edge by a plurality of frangible members, the plurality of frangible members providing a visual indication, when broken, that the closure has been opened;

a first line of weakness that separates the cylindrical wall and the retention band, wherein the plurality of frangible members extend across the first line of weakness and connect the cylindrical wall and the retention band, the first line of weakness extending circumferentially with respect to the rotational axis from a first end to a second end, wherein the first end and the second end are separated by a first angle with respect to the rotational axis, wherein the first angle is between 12 degrees and 30 degrees;

a second line of weakness that extends circumferentially with respect to the rotational axis, wherein the second line of weakness is distinct from the first line of weakness;

a first tether that couples the cylindrical wall to the retention band, wherein the first tether extends between the second line of weakness and the first end of the first line of weakness;

a second tether that couples the cylindrical wall to the retention band, wherein the second tether extends between the second line of weakness and the second end of the first line of weakness;

a tab extending away from the top panel towards the retention band, the tab defined by the second line of weakness and configured to interface against a container neck of a container subsequent to the closure being opened, thereby biasing the top panel away from the container neck;

wherein the closure is configured to be affixed to a container neck of a container, wherein the retention band is configured to remain coupled to the container after the closure has been opened, the tab comprising an upper portion and a lower portion that is further from the top panel than the upper portion, the lower portion defining an interfacing surface that interfaces against the container neck to bias the top panel away from an opening of the container neck;

wherein the lower portion of the tab extends circumferentially with respect to the rotational axis and defines a third angle with respect to the rotational axis, wherein the first angle is less than the third angle.

11. The closure of claim 10, wherein a ratio of the first angle to the third angle is between 1:1.2 and 1:1.7.

12. A closure comprising:

a top panel including an upper surface and a lower surface;

a rotational axis about which the top panel is centered;

a cylindrical wall extending from the lower surface of the top panel to a bottom edge of the cylindrical wall;

an inner surface of the cylindrical wall facing towards the rotational axis;

a retention band pivotally coupled to the cylindrical wall, the retention band attached to the bottom edge by a plurality of frangible members, the plurality of frangible members providing a visual indication, when broken, that the closure has been opened;

a first line of weakness that separates the cylindrical wall and the retention band, wherein the plurality of frangible members extend across the first line of weakness and connect the cylindrical wall and the retention band, the first line of weakness extending circumferentially with respect to the rotational axis from a first end to a second end, wherein the first end and the second end are separated by a first angle with respect to the rotational axis, wherein the first angle is between 12 degrees and 30 degrees;

a second line of weakness that extends circumferentially with respect to the rotational axis, wherein the second line of weakness is distinct from the first line of weakness, the second line of weakness defines a fourth angle with respect to the rotational axis between 45 degrees and 65 degrees;

a first tether that couples the cylindrical wall to the retention band, wherein the first tether extends between the second line of weakness and the first end of the first line of weakness; and a second tether that couples the cylindrical wall to the retention band, wherein the second tether extends between the second line of weakness and the second end of the first line of weakness.

13. A closure comprising:

a top panel including an upper surface and a lower surface;

a rotational axis about which the top panel is centered;

a cylindrical wall extending from the lower surface of the top panel to a bottom edge of the cylindrical wall;

an inner surface of the cylindrical wall facing towards the rotational axis;

a retention band pivotally coupled to the cylindrical wall, the retention band attached to the bottom edge by a plurality of frangible members, the plurality of frangible members providing a visual indication, when broken, that the closure has been opened;

a first line of weakness that separates the cylindrical wall and the retention band, wherein the plurality of frangible members extend across the first line of weakness and connect the cylindrical wall and the retention band, the first line of weakness extending more than 180 degrees circumferentially with respect to the rotational axis from a first end to a second end, wherein the first end and the second end are separated by a first angle with respect to the rotational axis, wherein the first angle is acute;

a second line of weakness extending less than 180 degrees circumferentially with respect to the rotational axis from a third end to a fourth end, wherein the second line of weakness is distinct from the first line of weakness, wherein the third end and the fourth end are separated by a second angle with respect to the rotational axis, wherein the second angle is acute, and wherein a ratio of the first angle to the second angle is between 1:4 and 1:6;

a first tether that couples the cylindrical wall to the retention band, wherein the first tether extends between the second line of weakness and the first end of the first line of weakness; and a second tether that couples the cylindrical wall to the retention band, wherein the second tether extends between the second line of weakness and the second end of the first line of weakness.

14. The closure of claim 13, wherein the second angle is between 45 degrees and 65 degrees.

15. The closure of claim 13, comprising a tab extending away from the top panel towards the retention band, the tab defined by the second line of weakness, the tab comprising an upper portion and a lower portion that is further from the top panel than the upper portion, the lower portion defining an interfacing surface that interfaces against the container neck to bias the top panel away from an opening of the container neck subsequent to the closure being opened, wherein the upper portion of the tab extends circumferentially with respect to the rotational axis and defines a third angle with respect to the rotational axis, and wherein a ratio of the first angle to the third angle is between 1:1.5 and 1:2.8.

16. The closure of claim 13, comprising a tab extending away from the top panel towards the retention band, the tab defined by the second line of weakness, the tab comprising an upper portion and a lower portion that is further from the top panel than the upper portion, the lower portion defining an interfacing surface that interfaces against the container neck to bias the top panel away from an opening of the container neck subsequent to the closure being opened, wherein the lower portion of the tab extends circumferentially with respect to the rotational axis and defines a fourth angle with respect to the rotational axis, and wherein a ratio of the first angle to the fourth angle is between 1:1.1 and 1:2.

17. The closure of claim 13, comprising a tab extending away from the top panel towards the retention band, the tab defined by the second line of weakness and configured to interface against a container neck of a container subsequent to the closure being opened, thereby biasing the top panel away from the container neck, the second line of weakness comprising a central portion and side portions that extend upward from the central portion, wherein the side portions define an angle between 20 degrees and 70 degrees with respect to a line parallel to the rotational axis.

18. A closure comprising:

a top panel including an upper surface and a lower surface;

a rotational axis about which the top panel is centered;

a cylindrical wall extending from the lower surface of the top panel to a bottom edge of the cylindrical wall;

an inner surface of the cylindrical wall facing towards the rotational axis;

a retention band pivotally coupled to the cylindrical wall, the retention band attached to the bottom edge by a plurality of frangible members, the plurality of frangible members providing a visual indication, when broken, that the closure has been opened;

a first line of weakness that separates the cylindrical wall and the retention band, wherein the plurality of frangible members extend across the first line of weakness and connect the cylindrical wall and the retention band, the first line of weakness extending more than 180 degrees circumferentially with respect to the rotational axis from a first end to a second end, wherein the first end and the second end are separated by a first angle with respect to the rotational axis, wherein the first angle is acute;

a second line of weakness extending less than 180 degrees circumferentially from a third end to a fourth end with respect to the rotational axis, the second line of weakness distinct from the first line of weakness, the third end and the fourth end defining a second angle with respect to the rotational axis, wherein the second angle is acute;

a tab that extends from the cylindrical wall, the tab defined by the second line of weakness, the tab configured to interface against a container neck of a container subsequent to the closure being opened, thereby biasing the cylindrical wall from the container neck, the tab comprising an upper portion and a lower portion that is further from the top panel than the upper portion, wherein the lower portion of the tab extends circumferentially a third angle with respect to the rotational axis, wherein the third angle is greater than the first angle;

a first tether that couples the cylindrical wall to the retention band, wherein the first tether extends between the second line of weakness and the first end of the first line of weakness; and a second tether that couples the cylindrical wall to the retention band, wherein the second tether extends between the second line of weakness and the second end of the first line of weakness.

19. The closure of claim 18, wherein the upper portion of the tab extends circumferentially with respect to the rotational axis a fourth angle that is greater than the first acute angle, wherein the fourth angle is acute.

20. The closure of claim 19, wherein the fourth angle is greater than the third angle.

* * * * *